US010247199B2

(12) United States Patent
Lee et al.

(10) Patent No.: US 10,247,199 B2
(45) Date of Patent: Apr. 2, 2019

(54) MULTI-VOLUTE SIROCCO FAN

(71) Applicant: KOREA INSTITUTE OF INDUSTRIAL TECHNOLOGY, Chungcheongnam-do (KR)

(72) Inventors: Kyoung-Yong Lee, Chungcheongnam-do (KR); Young Seok Choi, Gyeonggi-do (KR)

(73) Assignee: KOREA INSTITUTE OF INDUSTRIAL TECHNOLOGY, Chungcheongnam-do (KR)

( * ) Notice: Subject to any disclaimer, the term of this patent is extended or adjusted under 35 U.S.C. 154(b) by 384 days.

(21) Appl. No.: 15/104,977

(22) PCT Filed: Nov. 24, 2014

(86) PCT No.: PCT/KR2014/011313
§ 371 (c)(1),
(2) Date: Jun. 16, 2016

(87) PCT Pub. No.: WO2015/096739
PCT Pub. Date: Jun. 25, 2015

(65) Prior Publication Data

US 2017/0002829 A1 Jan. 5, 2017

(30) Foreign Application Priority Data

Dec. 16, 2013 (KR) ..... 10-2013-0156701

(51) Int. Cl.
*F04D 29/42* (2006.01)
*F04D 29/28* (2006.01)
*F04D 25/08* (2006.01)

(52) U.S. Cl.
CPC ..... *F04D 29/4246* (2013.01); *F04D 25/08* (2013.01); *F04D 29/282* (2013.01); *F05D 2260/33* (2013.01); *F05D 2260/36* (2013.01)

(58) Field of Classification Search
CPC .... F04D 25/08; F04D 29/282; F04D 29/4246; F05D 2260/33; F05D 2260/36
See application file for complete search history.

(56) References Cited

U.S. PATENT DOCUMENTS 3,231,176 A * 1/1966 Bowen ..... F04D 17/16 415/102
5,257,904 A * 11/1993 Sullivan ..... F04D 29/4233 403/11

(Continued)

FOREIGN PATENT DOCUMENTS

JP 2000104700 A 4/2000
JP 2006207523 A 8/2006

(Continued)

*Primary Examiner* — Igor Kershteyn
(74) *Attorney, Agent, or Firm* — Gokalp Bayramoglu

(57) ABSTRACT

Disclosed is a multi-volute sirocco fan (multiblade fan). The present invention relates to a multi-volute sirocco fan configured to discharge fluid into several directions while using one motor and one fan. The sirocco fan according to the present invention comprises: a driving motor; a fan connected to a rotation shaft of the driving motor to thus be rotated therewith, the fan having a plurality of vanes arranged and installed in a cylindrical shape along the circumferential direction thereof; and at least two stacked volutes in the center of which the fan is arranged and installed and which guide the fluid while the cross-sectional area formed by the upper and lower surfaces, side surfaces thereof and the outer circumferential surface of the fan is linearly increased.

6 Claims, 9 Drawing Sheets

(56) References Cited

U.S. PATENT DOCUMENTS

| | | | | |
|---|---|---|---|---|
| 6,030,173 | A * | 2/2000 | Bacchiocchi | F04D 17/105 415/98 |
| 2009/0145583 | A1* | 6/2009 | Han | F04D 29/282 165/121 |
| 2010/0044468 | A1* | 2/2010 | Granger | F04D 25/02 239/304 |
| 2010/0226802 | A1* | 9/2010 | Kawamura | H02K 16/02 417/423.7 |
| 2011/0280748 | A1 | 11/2011 | O'Connor, Jr. et al. | |
| 2013/0101451 | A1 | 4/2013 | Bergquist | |

FOREIGN PATENT DOCUMENTS

| | | | |
|---|---|---|---|
| JP | 2078157507 | A | 7/2008 |
| JP | 2010100108 | A | 5/2010 |
| KR | 100325257 | B1 | 2/2002 |
| KR | 1020090052761 | A | 5/2009 |

* cited by examiner (a)

(b)

MULTI-VOLUTE SIROCCO FAN

TECHNICAL FIELD

The present invention relates to a multi-volute sirocco fan (multiblade fan), and more particularly, to a multi-volute sirocco fan which is configured to discharge a fluid into several directions while using one motor and one fan.

BACKGROUND ART

Generally, a sirocco fan is a curved multi-blade fan which blows air forward with a plurality of curved blades. The sirocco fan is quiet, and thus widely used in an air conditioner for home use or use in buildings or plant factories.

In the sirocco fan, the plurality of curved blades are arranged and installed in the form of a cylinder in a circumferential direction, and a fan thereof is connected to a motor shaft to be rotated, and thus a fluid is moved by a pressure thereof.

A volute duct for forming a path of the fluid is installed around the fan, and the duct is provided so that a cross section thereof is linearly increased along a circumference of the fan. Therefore, the fluid suctioned from upper and lower sides of the fan is transferred along the path of the duct, i.e. a volute to a discharge port, and then discharged.

The sirocco fan according to a related art generally includes one fan, a motor and a volute. Therefore, the fluid which is introduced perpendicularly to a rotating direction of the fan toward an opposite side to the motor is rotated like a tornado along the volute, which is gradually widened, by rotation of a vane, i.e., the curved blade, and then discharged to an outside.

In such a structure of the sirocco fan, since the path is formed in a volute shape, it is difficult to control a discharge direction thereof after the sirocco fan is fixed. When it is intended to change the discharge direction, the entire device should be rotated and then fixed again, and when it is intended to divide a discharge amount, various ducts may be used, but there is a problem that a great pressure loss occurs.

As a related technique which has been developed to solve the problem, U.S. Pat. No. 6,896,478 has been disclosed. Here, the sirocco fan is configured to have a multi-volute, but it is just configured so that a number of sirocco fans are structurally attached. However, a case in which the motor is used together may occur, but it is also a simple coupling structure.

Since the multi-volute sirocco fan according to the related art is just configured by structurally coupling the number of sirocco fans, there is problem that a cost is increased due to a multi-structure.

DISCLOSURE

Technical Problem

The present invention is directed to providing a multi-volute sirocco fan which is configured to transfer a fluid into several directions and in different flow rates at the same time while using one motor and one fan.

Technical Solution

Therefore, the present invention is directed to providing a multi-volute sirocco fan including a driving motor; a fan connected to a rotation shaft of the driving motor to be rotated therewith, and having a plurality of vanes arranged and installed in a cylindrical shape along a circumferential direction thereof; and at least two stacked volutes in a center of which the fan is arranged and installed and which guide a fluid while a cross-sectional area thereof formed by upper and lower surfaces, side surfaces thereof and an outer circumferential surface of the fan is linearly increased.

A lower surface of a lowermost one of the volutes may be closed.

A rounded guide for guiding the fluid may be provided at an end of an upper surface central introduction port of an uppermost one of the volutes.

The volutes may be stacked, and then contact surfaces thereof may be welded and fixed.

A plurality of diameter reduction protruding portions of which diameters are reduced and which protrude may be provided at an upper surface central introduction port of a lower one of the volutes, and a plurality of diameter reduction grooves of which diameters are reduced and which protrude and then are bent to form grooves therein may be provided at a lower surface central introduction port of an upper one of the volutes, and when the upper and lower volutes are coupled, ends of the diameter reduction protruding portions may be fitted and coupled to the diameter reduction grooves.

A plurality of protruding portions may be provided at a lower surface central introduction port of an upper one of the volutes, and may be bent and assembled so as to cover an end of a central introduction port of an upper surface of a lower volute while the upper volute is stacked with the lower volute.

A height of each of the volutes may be provided to be different from each other.

Advantageous Effects

The present invention as described above has the following effects.

(1) In the multi-volute sirocco fan according to the present invention, since one sirocco fan is used while being divided into the plurality of volutes, the fluid can be transferred in various directions.

(2) Since the multi-volute sirocco fan according to the present invention has a structure in which the plurality of volutes are stacked at one sirocco fan, and the fluid is transferred along the originally designed volutes, the fluid can be transferred without the pressure loss in a desired direction.

(3) In the multi-volute sirocco fan according to the present invention, since a height of each of the plurality of volutes is differently controlled, an amount of the fluid which is discharged into different directions from each other can be differently controlled.

MODES OF THE INVENTION

Objects, characteristics and advantages of the present invention will be more apparent from the following detailed description. Hereinafter, preferred embodiments will be described in detail with reference to the accompanying drawings.

As illustrated in FIGS. 1 to 4, a multi-volute sirocco fan according to a first embodiment of the present invention includes a driving motor M, a fan 30 which is connected to a rotation shaft M1 of the driving motor M to be rotated therewith, and has a plurality of vanes 31 arranged and installed in a cylindrical shape along a circumferential direction thereof, and two stacked volutes 10 and 20 in the center of which the fan 30 is arranged and installed and which guide a fluid while a cross-sectional area formed by upper and lower surfaces, side surfaces thereof and an outer circumferential surface of the fan 30 is linearly increased.

Figure 1:
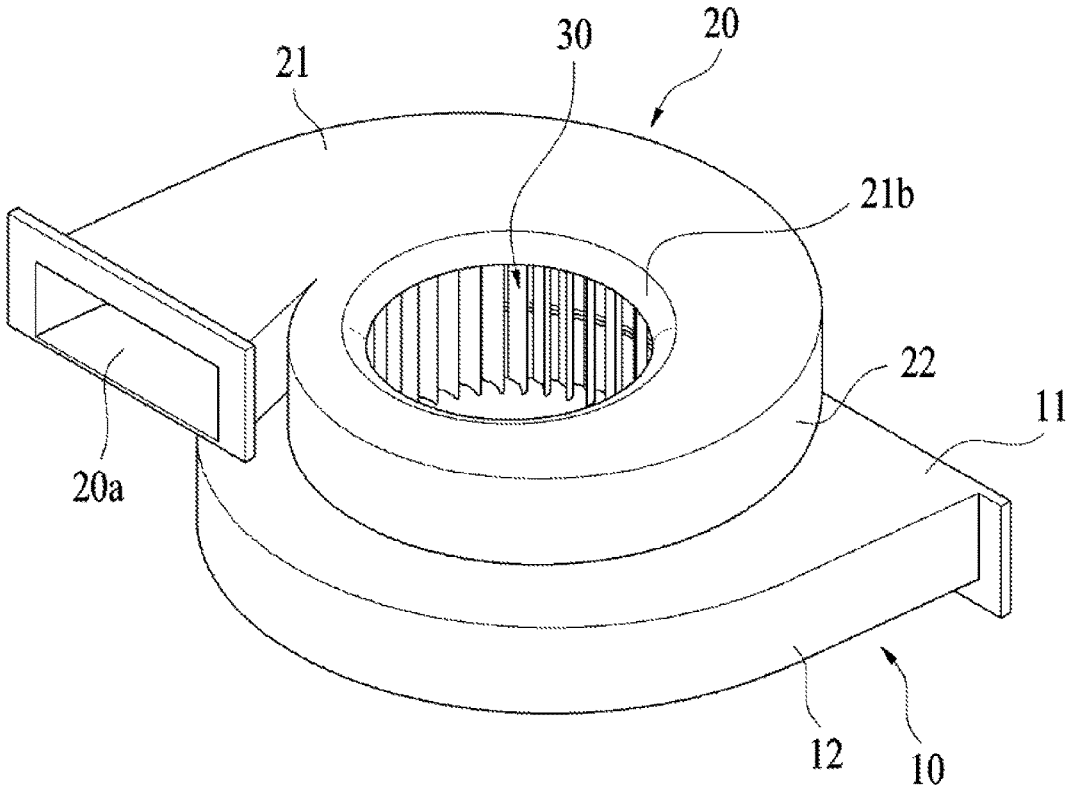
FIG. 1 is a perspective view of a multi-volute sirocco fan according to a first embodiment of the present invention.

Referring to FIG. 1, the two upper and lower volutes 10 and 20 are stacked, and each of the volutes 10 and 20 is directed to a discharge port 10*a* in an opposite direction to each other. Therefore, the fluid may be discharged from one sirocco fan in two directions.

The fluid is introduced through central introduction ports 21*a* and 23*a* of the second volute 20, and then discharged along the volutes 10 and 20 to each of the discharge ports 10*a* and 20*a* by the fan 30.

Figure 2:
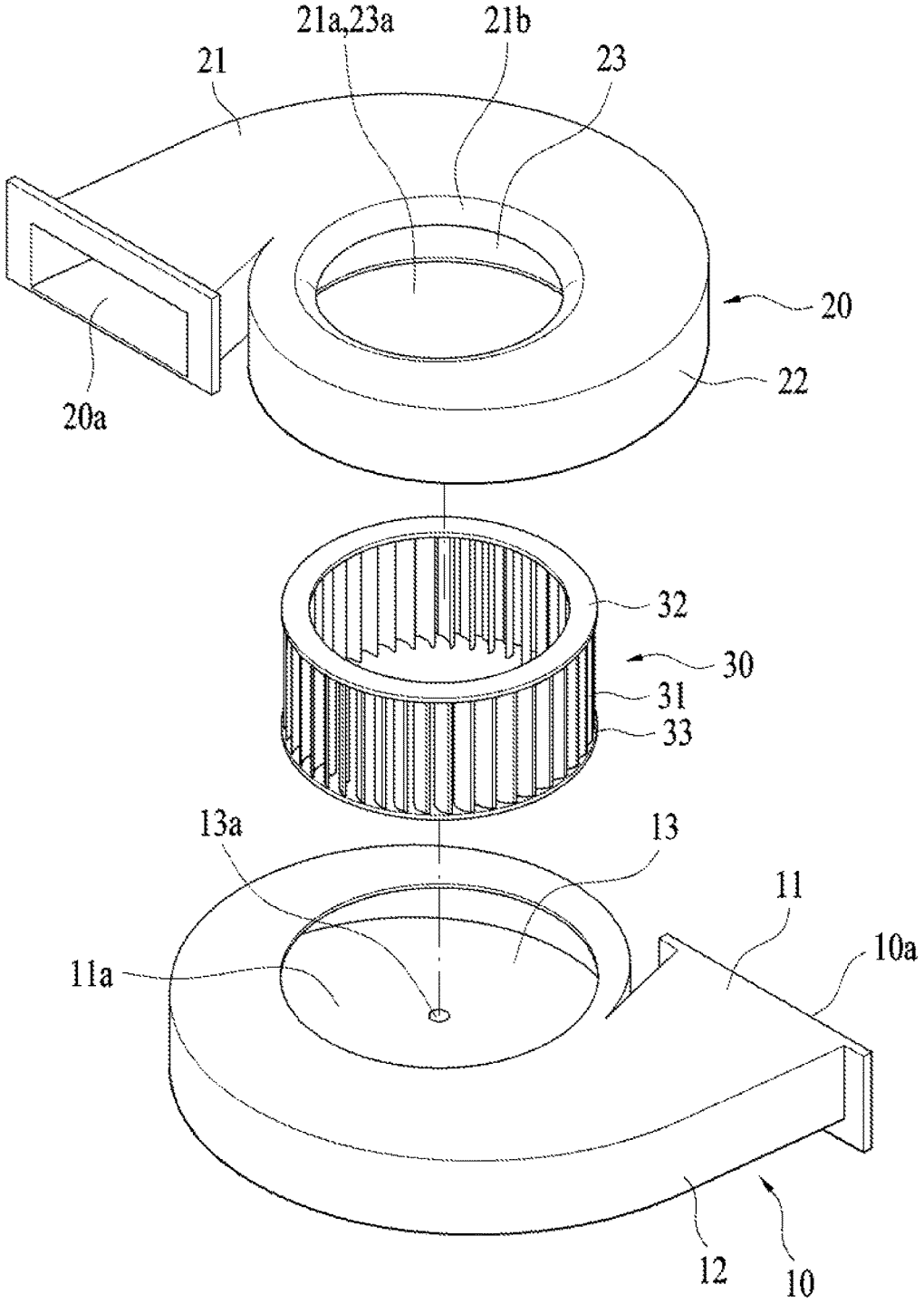
FIG. 2 is an exploded perspective view of the multi-volute sirocco fan according to the first embodiment of the present invention.

FIG. 2 illustrates a state in which components of the sirocco fan are disassembled. The fan 30 is inserted into a central introduction port 11*a* of the first volute 10. Then, the fan 30 is connected to the rotation shaft M1 passed through a center of a lower plate 13 of the first volute 10, and rotated by driving of the driving motor M.

The fan 30 includes upper and lower rims 32 and 33, and a plurality of vanes 31 which are installed between the upper and lower rims 32 and 33. Such a fan 30 is a typical fan. Of course, a height of the fan 30 is similar to a height formed by stacking the first and second volutes 10 and 20.

A part of the fan 30 is inserted into the second volute 20 through the lower central introduction port 23*a*, and a lower plate 23 of the second volute 20 is stacked so as to be in close contact with an upper plate 10 of the first volute 10.

An important point is that the central introduction ports 21*a*, 23*a* and 11*a* of the first and second volutes 10 and 20 and a center of the fan 30 should be located on the same axis, regardless of directions to which the discharge ports 10*a* and 20*a* of the first and second volutes 10 and 20 are directed.

As illustrated in FIG. 2, the central introduction ports 21*a* and 23*a* are provided at upper and lower portions of the second volute 20, and the second volute 20 is configured so that a cross-sectional area of a path formed by the upper and lower plates 21 and 23 and a side plate 22 is gradually linearly increased, and the discharge port 20*a* is provided at a last portion thereof.

A rounded guide 21*b* which is bent in a streamline shape to guide the fluid is provided at an end of the central introduction port 21*a* of the upper plate 21 of the second volute 20. Accordingly, a vortex phenomenon which occurs at a corner part is reduced, and thus the fluid introduced into the central introduction port 21*a* may be smoothly introduced into the fan 30.

Like the second volute 20, the first volute 10 includes the upper and lower plates 11 and 13, and a side plate 12, and the discharge port 10*a* is provided at a last portion thereof. However, the central introduction port 11*a* is formed at the upper plate 11, but the lower plate 13 is closed, and a through-hole 13*a* is formed at only a center thereof so that the rotation shaft M1 passes therethrough.

As illustrated in FIG. 2, the first and second volutes 10 and 20 are provided so as to discharge the fluid in opposite directions of 180 degrees.

The first and second volutes 10 and 20 are assembled and stacked in a desired angle, and then contact surfaces thereof may be welded and fixed.

After the installation, when it is applied to a system in which a direction thereof is not changed, the welding is preferable for use.

Figure 3:
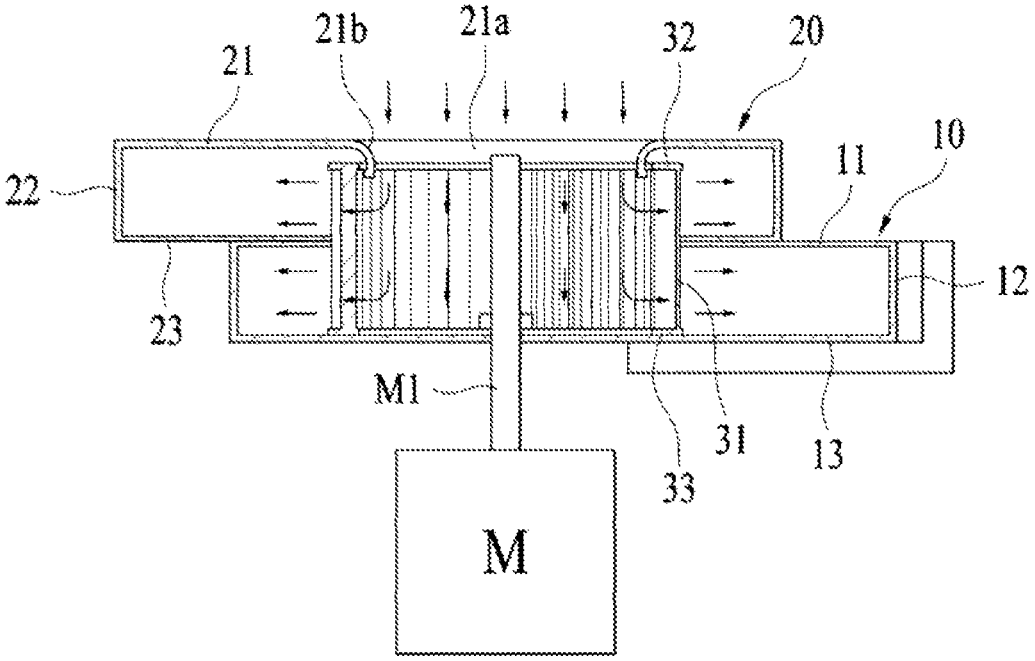
FIG. 3 is a longitudinal cross-sectional view of the multi-volute sirocco fan according to the first embodiment of the present invention.

Referring to FIG. 3, the first and second volutes 10 and 20 are stacked and fixed, and the fan 30 is installed at a center thereof. The fan 30 is connected to the rotation shaft M1 of the driving motor M.

Here, the vanes 31 is fixed by the upper and lower rims 32 and 33, formed in a cylindrical shape, and connected and fixed to the rotation shaft M1 by a plurality of spokes. The spokes are omitted to prevent complexity of the drawing.

As described above, when the driving motor M is rotated, the fan 30 starts to be rotated. Then, external air is introduced into the central introduction port 21*a* of the second volute 21 due to a hydraulic pressure generated by the vanes 31, and the introduced air is accelerated along the paths of the first and second volutes 10 and 20, and then discharged through each of the discharge ports 10*a* and 20*a*.

Therefore, the fluid introduced into one introduction port 21*a* may be discharged into different directions without an energy loss.

Figure 4:
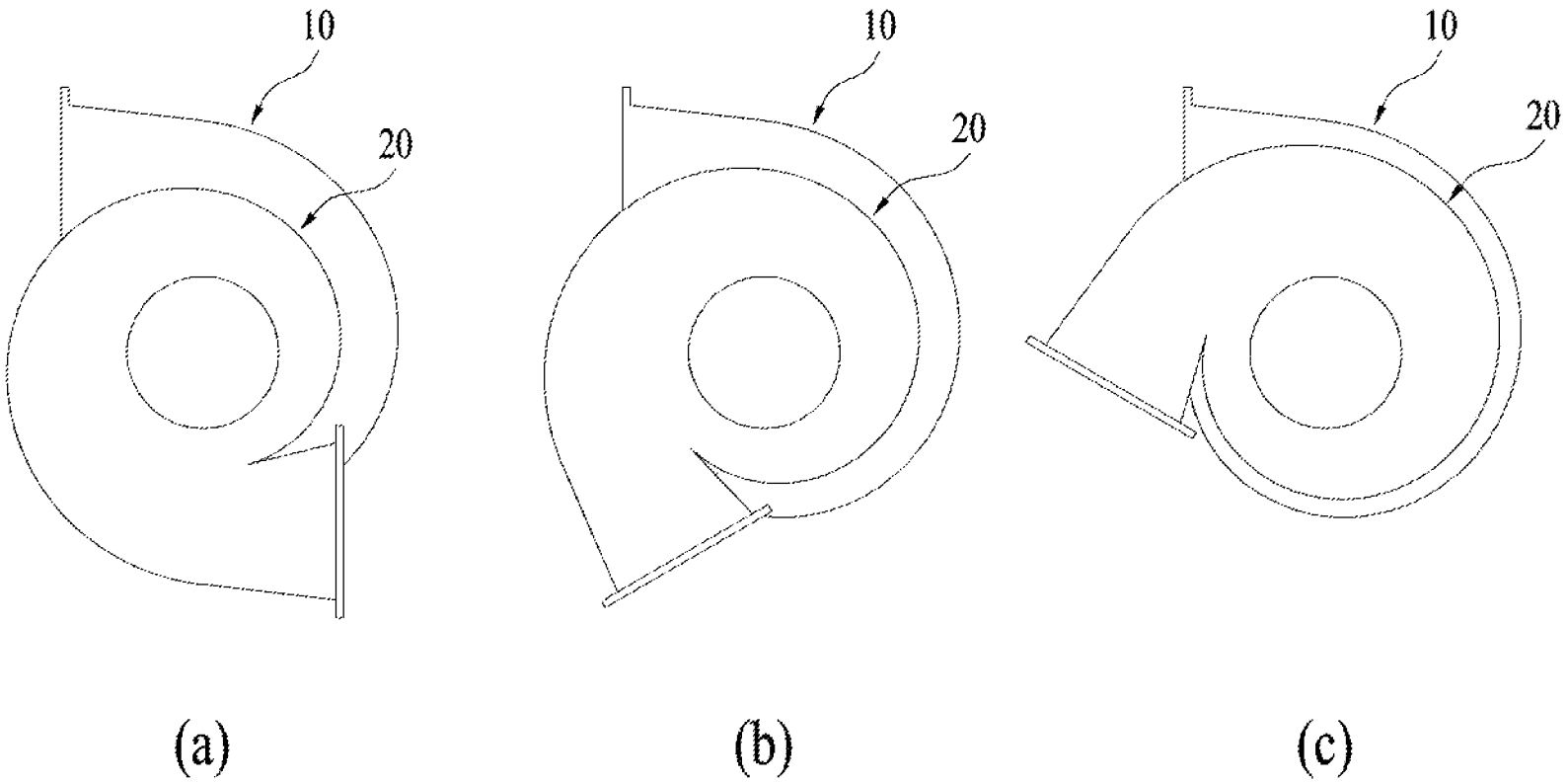
FIG. 4 is a view illustrating various application examples of the multi-volute sirocco fan according to the first embodiment of the present invention.

FIG. 4 illustrates a state in which the discharge ports of the volutes 10 and 20 may be formed in various directions in the sirocco fan according to the present invention. That is, FIG. 4*a* illustrates a state in which the discharge ports are arranged with a phase difference of 180 degrees, FIG. 4*b* illustrates a state in which the discharge ports are arranged with a phase difference of 120 degrees, and FIG. 4*c* illustrates a state in which the discharge ports are arranged with a phase difference of 60 degrees.

Of course, in the case in which, instead of the two volutes, a plurality of volutes are used, the directions of the discharge ports may be set more variously.

Figure 5:
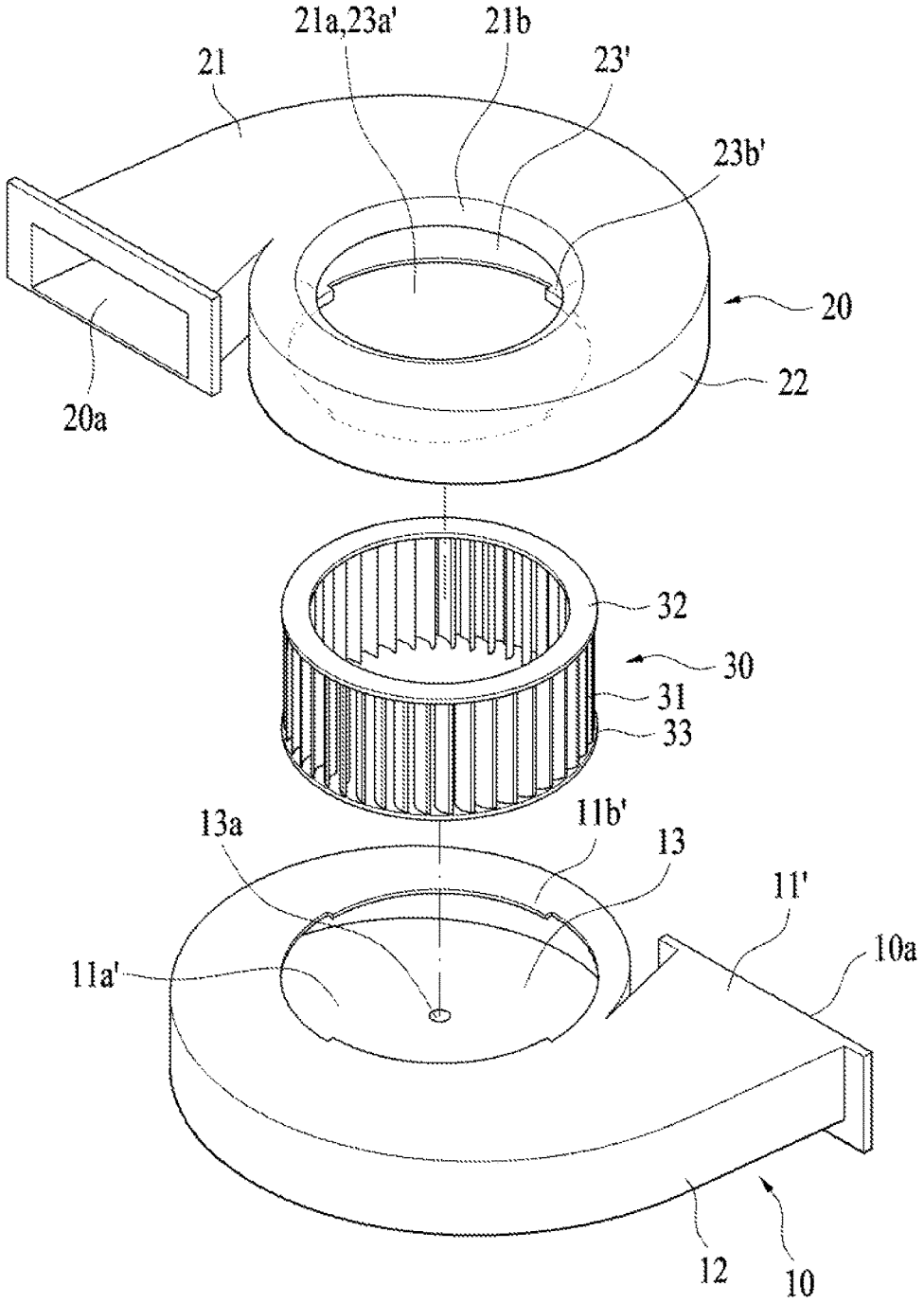
FIG. 5 is an exploded perspective view of a multi-volute sirocco fan according to a second embodiment of the present invention.
Figure 6:
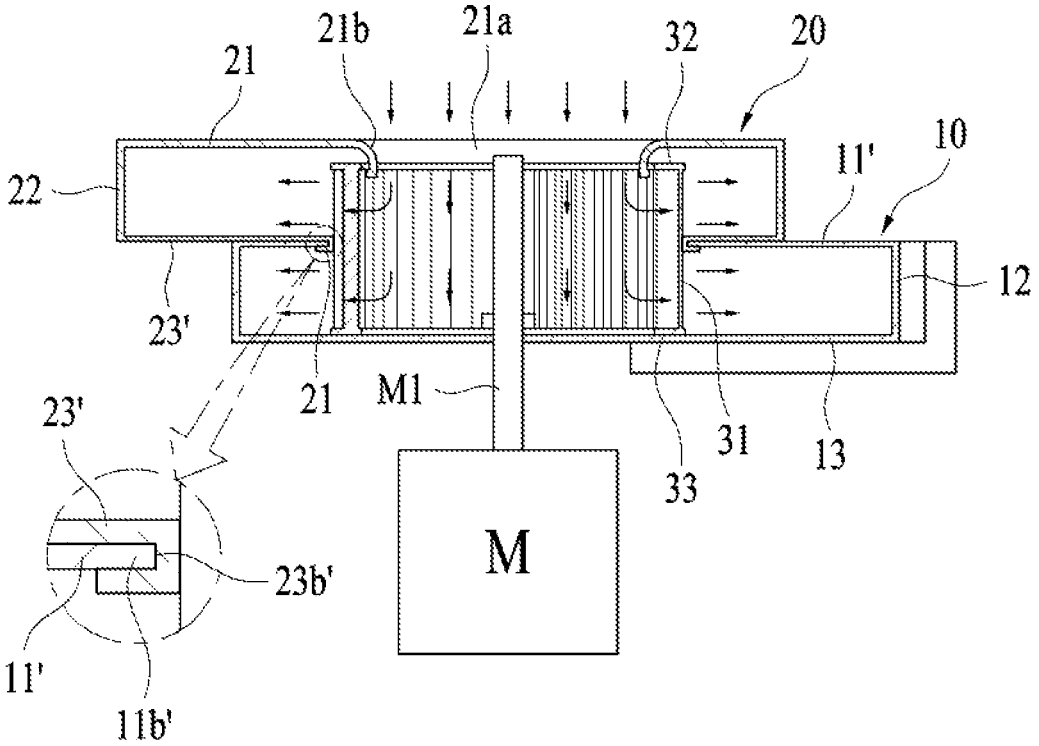
FIG. 6 is a longitudinal cross-sectional view of the multi-volute sirocco fan according to the second embodiment of the present invention.

Meanwhile, referring to FIGS. 5 and 6, in a sirocco fan according to a second embodiment of the present invention, a plurality of diameter reduction protruding portions 11*b*' of which diameters are reduced and which protrude are provided at an upper surface central introduction port 11*a*' of the first volute 10, and a plurality of diameter reduction grooves 23*b*' of which diameters are reduced and which protrude and then are bent to form grooves therein are provided at a lower surface central introduction port 23*a*' of the second volute 20, and when the first and second volutes 10 and 20 are coupled, ends of the diameter reduction protruding portions 11*b*' are fitted and coupled to the diameter reduction grooves 23*b*'.

Referring to FIG. 5, the fan 30 of the sirocco fan is the same, but a lower plate 23' of the upper volute 20 and an upper plate 11' of the first volute 10 are different from those in the previous embodiment.

That is, the diameter reduction grooves 23*b*' are formed at an angular interval of 90 degrees, and thus two diameter reduction grooves 23*b*' are provided at the lower plate of the second volute 20, and the diameter reduction protruding portions 11*b*' are also formed at an angular interval of 90 degrees, and thus two diameter reduction protruding portions 11*b*' are provided at the upper plate 11' of the first volute 10. Therefore, when the diameter reduction grooves 23*b*' are rotated so as not to interfere with the diameter reduction protruding portions 11*b*', and then the first and second volutes 10 and 20 comes in close contact with each other, the lower plate 23' of the second volute 20 is in close contact with the upper plate 11' of the first volute 10, and the diameter reduction grooves 23*b*' are slightly inserted into the first volute 10.

In this state, when one of the first and second volutes 10 and 20 is rotated, the diameter reduction protruding portions 11*b*' are inserted into the diameter reduction grooves 23*b*', and thus an assembling operation is performed. Of course, a disassembling operation may be reversely performed.

FIG. 6 illustrates an assembled state. As illustrated in the drawing, the first and second volutes 10 and 20 are maintained in the firmly assembled state by coupling between the diameter reduction grooves 23*b*' and the diameter reduction protruding portions 11*b*'.

In this embodiment, since the first and second volutes 10 and 20 have an assemblable structure, there is an advantage that discharge ports 10*a* and 20*a* of the first and second volutes 10 and 20 may be frequently changed at various angles.

Of course, an operation of the sirocco fan is the same as that of the sirocco fan according to the first embodiment.

Figure 7:
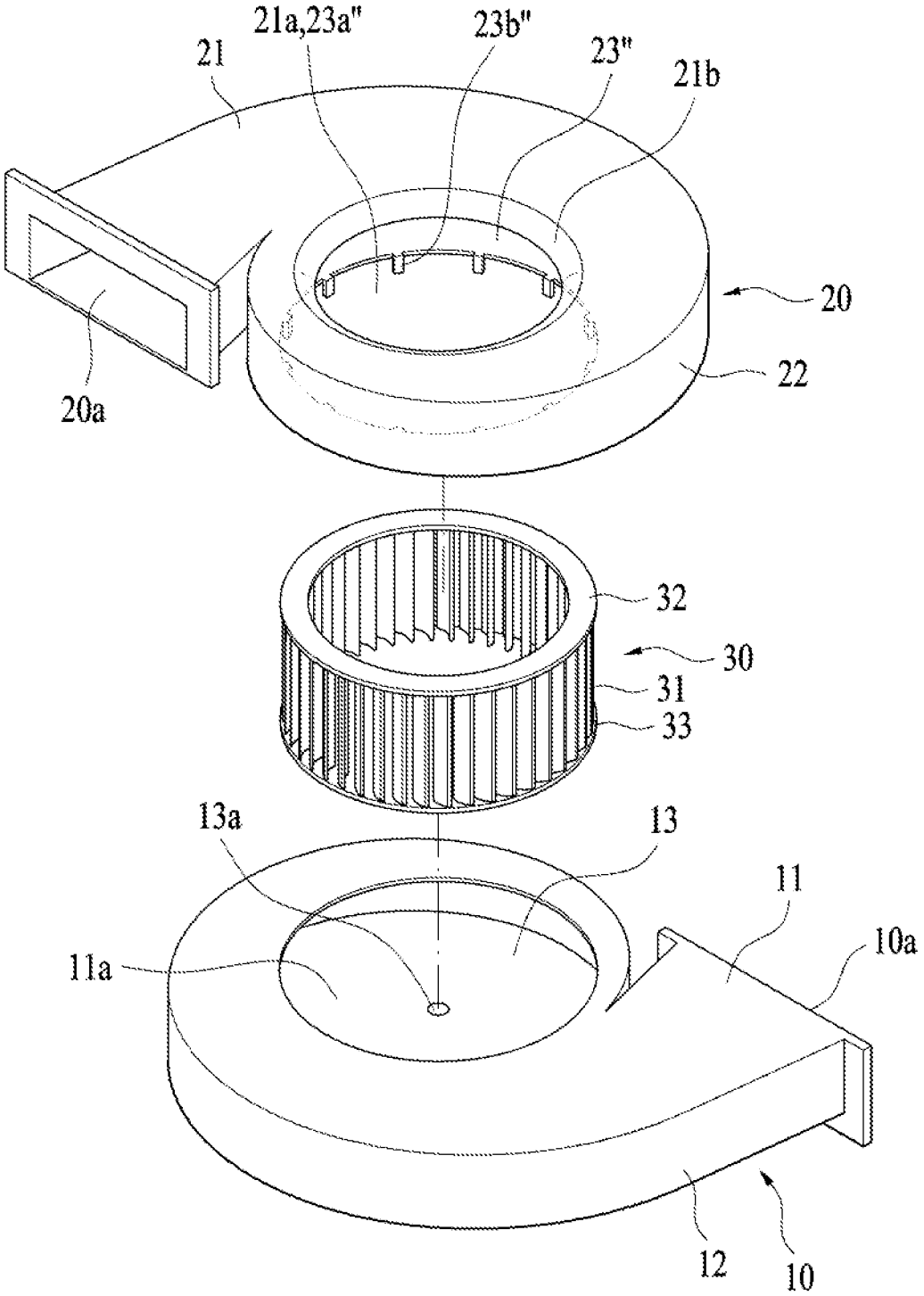
FIG. 7 is an exploded perspective view of a multi-volute sirocco fan according to a third embodiment of the present invention.
Figure 8:
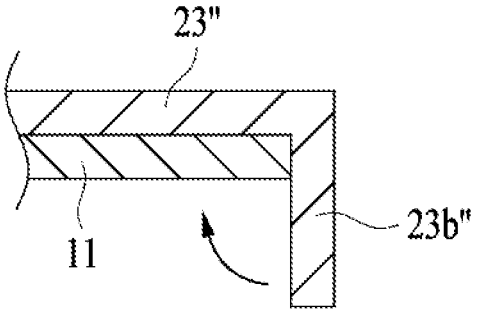
FIG. 8 is an assembly view of the multi-volute sirocco fan according to the third embodiment of the present invention.
Figure 8:
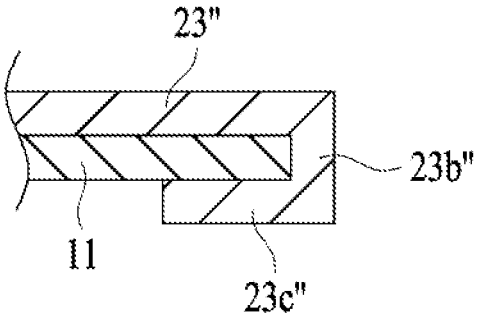

Meanwhile, referring to FIGS. 7 and 8, in a sirocco fan according to a third embodiment of the present invention, a plurality of protruding portions 23*b*" are provided at the lower surface central introduction port 23*a*' of the second volute 20 of the volutes, and are bent and assembled so as to cover an end of the central introduction port 11*a* of the upper plate 11 of the first volute 10 while the second volute 20 is stacked with the first volute 10.

When comparing with the first embodiment, the present embodiment is different from the first embodiment in that the plurality of protruding portions 23*b*" are formed at the central introduction port 23*a*" of a lower plate 23" of the second volute 20.

Therefore, when the second volute 20 is aligned with and fitted to the first volute 10, the protruding portions 23*b*" slightly protrude to an inside through the lower central introduction port 11*a* (referring to FIG. 8*a*).

In this state, when ends of the protruding portions 23*b*" are bent, a state illustrated in FIG. 8*b* is achieved, and thus the first and second volutes 10 and 20 are fixed.

The third embodiment in which the first and second volutes 10 and 20 are fixed using the protruding portions 23*b*" has a very simple structure, and also has an advantage that the assembling operation is easily performed. Of course, in this case, the first and second volutes 10 and 20 are fixed, and thus it is impossible to control the directions of the discharge ports 10*a* and 20*a*.

Figure 9:
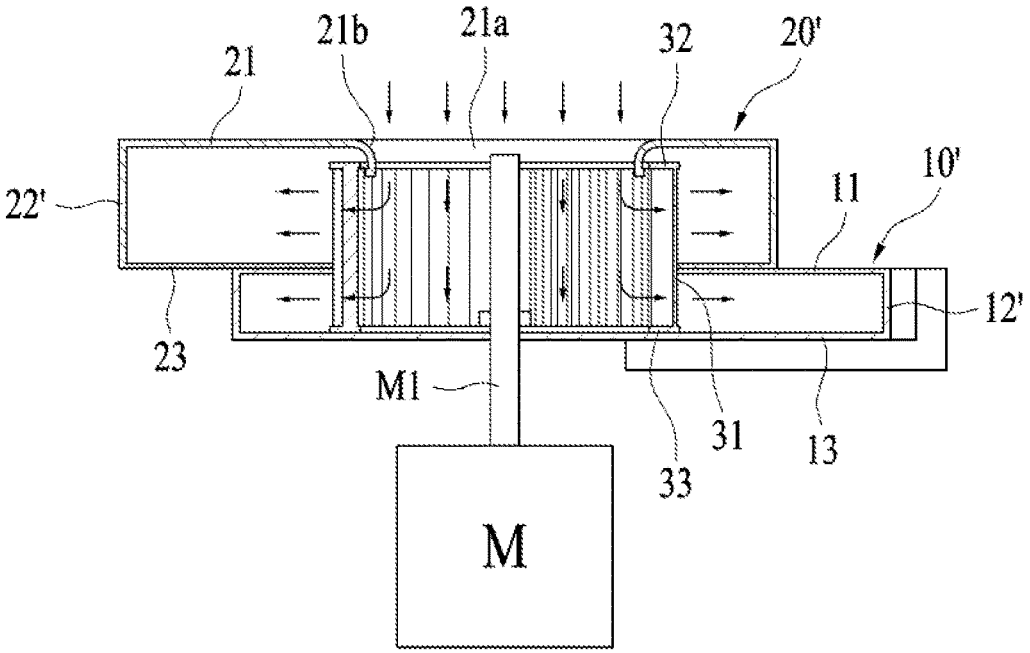
FIG. 9 is a cross-sectional view of a multi-volute sirocco fan according to a fourth embodiment of the present invention.

Meanwhile, as illustrated in FIG. 9, in a sirocco fan according to a fourth embodiment of the present invention, heights of first and second volutes 10' and 20' are provided to be different from each other.

Like this, when the heights of the first and second volutes 10' and 20' are formed to be different from each other, and thus discharge cross-sectional areas thereof are different from each other, an amount of the fluid to be discharged is also different.

Referring to FIG. 9, a height of a side plate 12' of the first volute plate 10 is relatively lower than that of a side plate 22' of the second volute 20'. Therefore, the fluid introduced from an upper side is introduced and discharged along each of the volutes 10' and 20' by the operation of the fan 30, and thus the amount of the fluid discharged to the first volute 10' having a small area is smaller than that of the fluid discharged to the second volute 20'.

Like this, by controlling the height of each of the volutes 10' and 20', the amount of the fluid discharged in different directions from each other may also be adjusted.

Although a few embodiments of the present invention have been shown and described, it would be appreciated by those skilled in the art that changes may be made in these embodiments without departing from the principles and spirit of the invention, the scope of which is defined in the claims and their equivalents.

INDUSTRIAL APPLICABILITY

The sirocco fan according to the present invention can be used in various air conditioner systems or the like in which the fluid is moved.

The invention claimed is:

1. A multi-volute sirocco fan, comprising:

a driving motor;

a fan connected to a rotation shaft of the driving motor to be rotated therewith, and having a plurality of vanes arranged and installed in a cylindrical shape along a circumferential direction thereof; and at least two stacked volutes in a center of which the fan is arranged and installed and which guide a fluid while a cross-sectional area thereof formed by upper and lower surfaces, side surfaces thereof and an outer circumferential surface of the fan is linearly increased; and wherein a plurality of diameter reduction protruding portions of which diameters are reduced and which protrude are provided at an upper surface central introduction port of a lower one of the volutes, and a plurality of diameter reduction grooves of which diameters are reduced and which protrude and then are bent to form grooves therein are provided at a lower surface central introduction port of an upper one of the volutes, and when the upper and lower volutes are coupled, ends of the diameter reduction protruding portions are fitted and coupled to the diameter reduction grooves.

2. The multi-volute sirocco fan of claim 1, wherein a lower surface of a lowermost one of the volutes is closed.

3. The multi-volute sirocco fan of claim 1, wherein a rounded guide for guiding the fluid is provided at an end of an upper surface central introduction port of an uppermost one of the volutes.

4. The multi-volute sirocco fan of claim 1, wherein the volutes are stacked, and then contact surfaces thereof are welded and fixed.

5. The multi-volute sirocco fan of claim 1, wherein a plurality of protruding portions are provided at the lower surface central introduction port of the upper one of the volutes, and bent and assembled so as to cover an end of a central introduction port of an upper surface of the lower volute while the upper volute is stacked with the lower volute.

6. The multi-volute sirocco fan of claim 1, wherein a height of each of the volutes is provided to be different from each other.

* * * * *